US006769460B2

(12) United States Patent
Persson

(10) Patent No.: US 6,769,460 B2
(45) Date of Patent: Aug. 3, 2004

(54) CONTROL VALVE

(75) Inventor: Osborn Persson, Halmstad (SE)

(73) Assignee: OPW Fueling Components, Hamilton, OH (US)

( * ) Notice: Subject to any disclaimer, the term of this patent is extended or adjusted under 35 U.S.C. 154(b) by 0 days.

(21) Appl. No.: 10/362,413

(22) PCT Filed: Aug. 24, 2001

(86) PCT No.: PCT/SE01/01805

§ 371 (c)(1),
(2), (4) Date: Aug. 4, 2003

(87) PCT Pub. No.: WO02/16253

PCT Pub. Date: Feb. 28, 2002

(65) Prior Publication Data

US 2004/0025960 A1 Feb. 12, 2004

(30) Foreign Application Priority Data

Aug. 25, 2000 (SE) ..... 0003032

(51) Int. Cl.[7] ..... B65B 31/00

(52) U.S. Cl. ..... 141/59; 141/301; 141/392; 137/536

(58) Field of Search ..... 141/59, 206–216, 141/392, 301; 137/514.7, 536, 542

(56) References Cited

U.S. PATENT DOCUMENTS 4,440,189 A * 4/1984 Graham ..... 137/115.18
5,720,325 A * 2/1998 Grantham ..... 141/59
5,782,259 A * 7/1998 Ledbetter et al. ..... 137/71

* cited by examiner

*Primary Examiner*—Steven O. Douglas
(74) *Attorney, Agent, or Firm*—Dinsmore & Shohl LLP

(57) ABSTRACT

The present invention relates to a device for controlling the recovery of vapour at stations for the dispensing of liquid fuels, e.g. petrol of various grades, from a first tank or container to a second tank or container by the intermediary of a pump and a line and/or hose with a nozzle, e.g. a pistol valve, and with a channel and/or hose for the recovery and recycling of vapour from the second tank or container to the first tank or container, or some other auxiliary aid for managing the vapour, a valve being disposed in the line or the hose between the pump and the nozzle and including at least one through flow channel (14–19) for the fuel and at least one through flow channel (13) for the vapour which is to be recovered and recycled the valve having a valve cone (12) and a valve seat (11) and the valve cone (12) being switchable against the action of a spring (9) from closure abutment against the valve seat corresponding to the fuel flow occuring in the through flow channel (14–19) so that vapour is recovered and recycled via the valve seat (11) in proportion to the fuel flow.

7 Claims, 10 Drawing Sheets

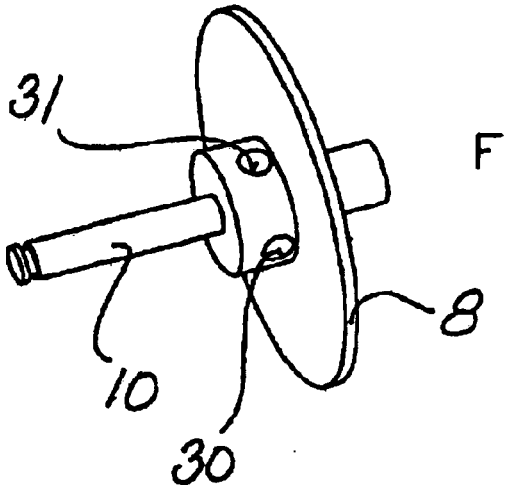
Fig.17
Fig.20
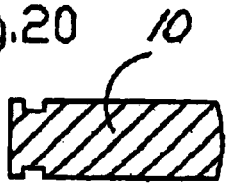
Fig.18
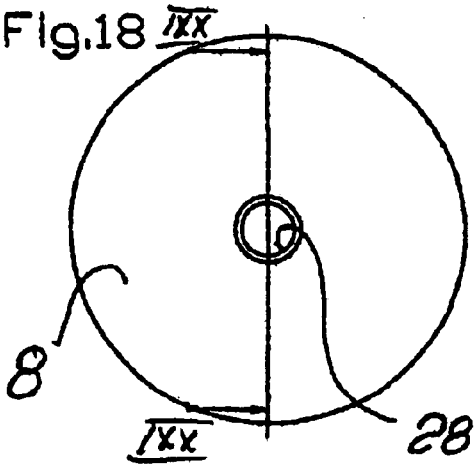
Fig.19
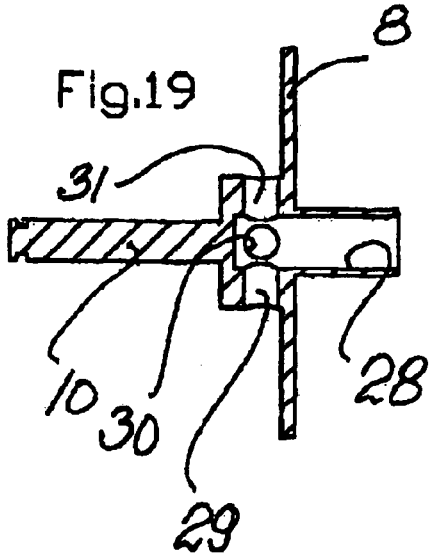

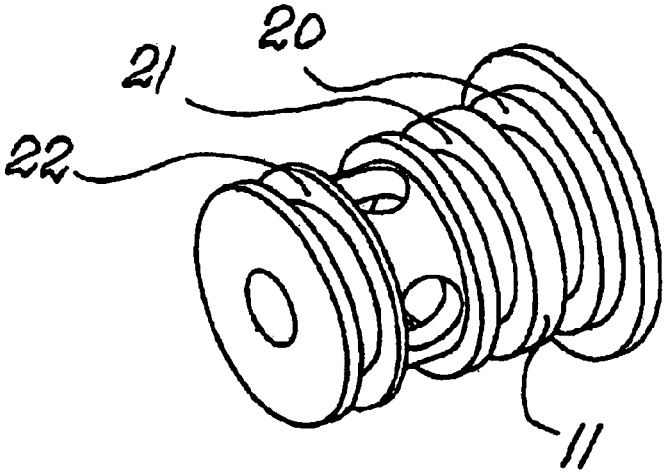
Fig.21
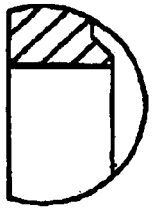
Fig.24
Fig.22
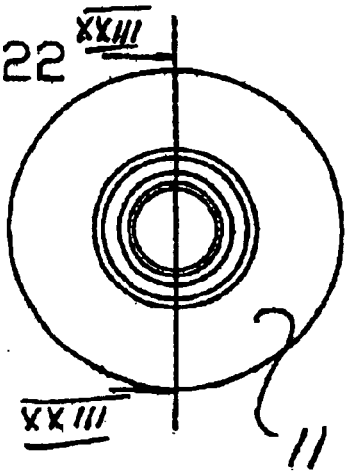
Fig.23
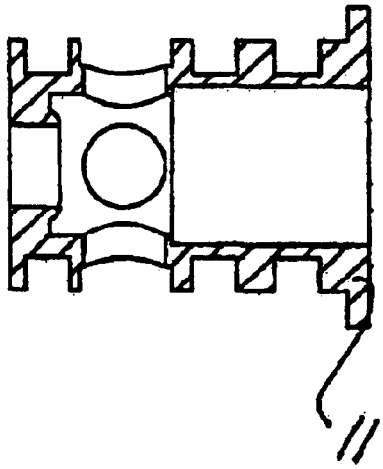

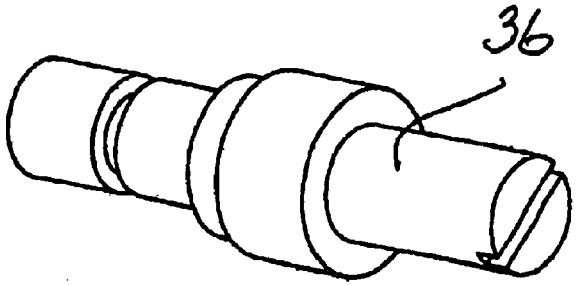
Fig.25
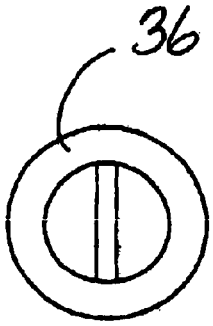
Fig.26
Fig.27
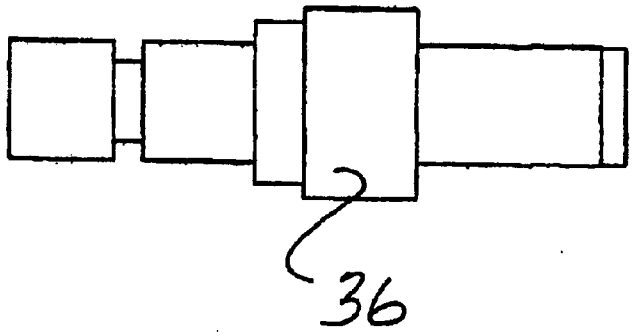

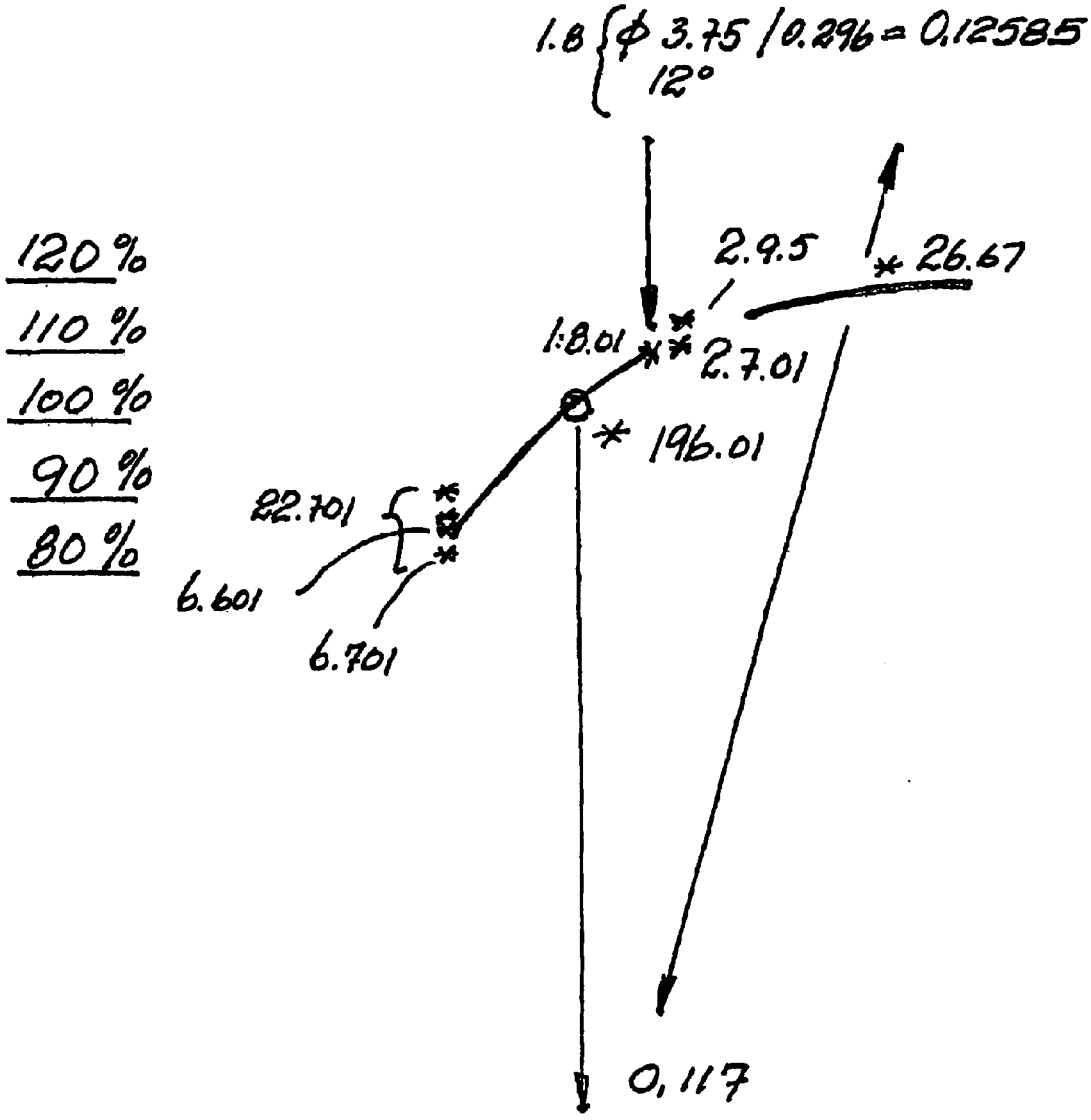
Fig 31 a1 a12 a13

CONTROL VALVE

The present invention relates to a device for controlling the recovery of vapour at stations for the dispensing of liquid fuels, e.g. petrol of various grades, from a first tank or container to a second tank or container by the intermediary of a pump and a line and/or hose with a nozzle, e.g. a pistol valve, and with a channel and/or hose for the recovery and recycling of vapour from the second tank or container to the first tank or container, or some other auxiliary aid for managing the vapour.

Prior art devices for the control of vapour recovery and recycling at tank stations include both mechanical valves and complex electronics for controlling the valves. These prior art devices entail high costs and constitute a troublesome source of problems and unreliability. The growingly encompassing environmental demands place increasingly higher standards on correct vapour recovery. Present requirements of a recovery rate of at least 95% can be met using prior art devices. However, more stringent requirements may entail a considerably higher level of complexity in the prior art devices. This will entail considerably higher costs which greatly counteract a willingness to comply.

The task forming the basis of the present invention is to realise an improved and simplified device for controlling vapour recovery.

This task is solved according to the present invention in that the device intimated by way of introduction is characterised in that a valve is disposed in the line or hose between the pump and the nozzle and includes at least one through flow channel for the fuel and at least one through flow channel for the vapour which is to be recovered, that the valve has a valve cone and a valve seat, and that the valve cone is switchable against the action of a spring from closure abutment against the valve seat corresponding to the fuel flow occurring in the through flow channel, so that vapour is recovered and recycled via the valve seat in proportion to the fuel flow. The valve cone is disposed on the end of a piston rod whose opposite end extends through a cylinder cavity and out through a cylinder top, and has a plate for movement in the cylinder cavity and co-operation with the cylinder wall. Said opposite piston end has a channel which is open in the piston end and discharges on the opposing side of the plate in the part of the cylinder cavity located on this side of the plate. The cylinder cavity between the plate and the cylinder top is, via a number of apertures, in communication with the surrounding through flow channel for the fuel. Said opposing piston end carries a compression spring for abutment against the plate and the cylinder top for urging the piston in a direction away from the cylinder top and the valve cone in a direction towards the valve seat. The valve seat discharges in a space for leading off vapour to the first tank or an auxiliary aid for management of the vapour. An outlet from the space is provided with an adjustment screw for basic adjustment of the gas recovery and recycling by means of the valve.

The present invention realises an extremely efficient control valve which makes for the elimination of all electronics called for in prior art valve arrangements. The control valve in the present invention is moreover extremely simple and reliable. The valve according to the present invention is mounted quite simply between the fuelling hose and the outlet from the pump. This implies an extremely simple and reliable arrangement, since the valve according to the present invention is mounted in a protected and safe place. The entirely mechanical construction and simple adjustment possibilities moreover make it possible to apply the valve to new stations and retrofit the valve to old stations, since it is simple to adjust the valve according to the present invention in response to the conditions prevailing at the station in question.

One embodiment of the present invention will be described in greater detail hereinbelow with reference to the accompanying drawings.

FIG. 17 is a perspective view of a piston for the device in FIG. 1.

FIG. 18 is an end elevation of the piston illustrated in FIG. 17.

FIG. 19 shows a section in the direction of the arrows IXX—IXX in FIG. 18.

FIG. 20 shows a part of the piston rod on a larger scale, this part being encircled in FIG. 19.

FIG. 21 is a perspective view of a valve seat for the device according to the present invention.

FIG. 22 is an end elevation of the valve seat in FIG. 21.

FIG. 23 shows a section in the direction of the arrows XXII—XXII in FIG. 22.

FIG. 24 shows, on a larger scale, a part of the valve seat, this part being encircled in FIG. 23.

FIG. 25 is a perspective view of an adjustment screw for the device according to the present invention.

FIG. 26 is an end elevation of the adjustment screw in FIG. 25.

FIG. 27 is a side elevation of the adjustment screw in FIGS. 25 and 26.

FIG. 31 shows a curve of the vapour rate through the valve at different dimensions of the gap between the valve seat and the valve seat end of a device according to the present invention.

Figure 2:
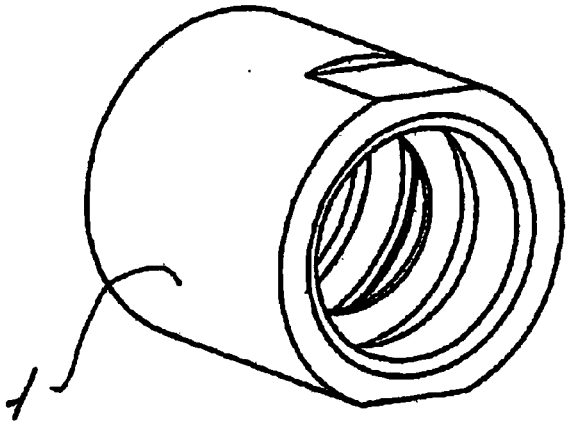
FIG. 2 is a perspective view of a housing section for the device in FIG. 1.
Figure 3:
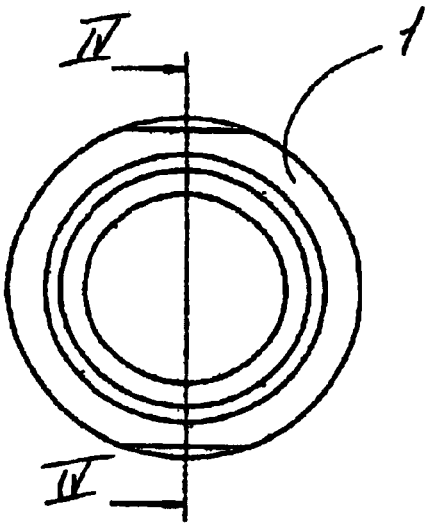
FIG. 3 shows an end elevation of the housing section in FIG. 2.
Figure 4:
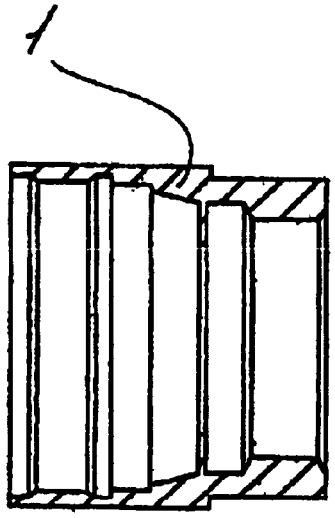
FIG. 4 shows a section in the direction of the arrows IV—IV in FIG. 3.
Figure 5:
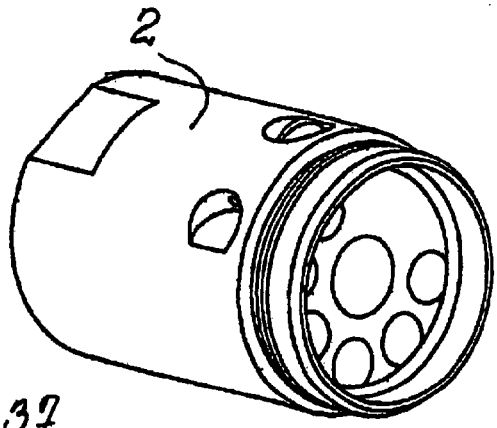
FIG. 5 is a perspective view of a further housing section for the device in FIG. 1.
Figure 7:
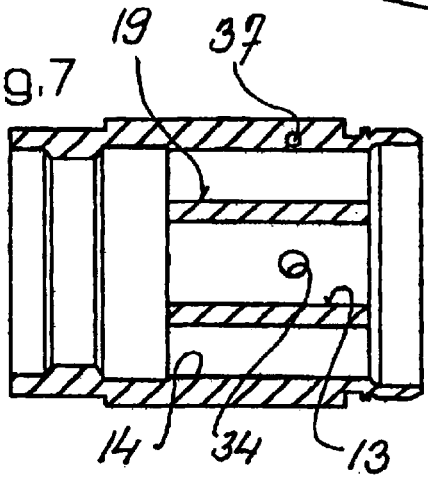
FIG. 7 shows a section in the direction of the arrows VII—VII in FIG. 6.
Figure 6:
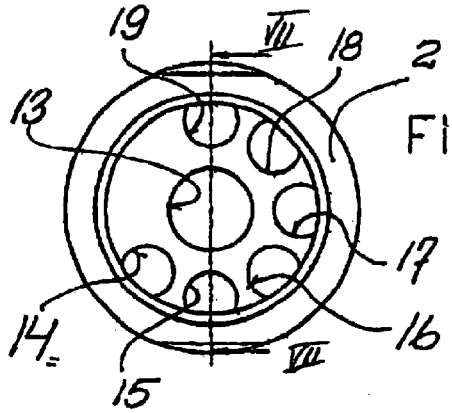
FIG. 6 shows an end elevation of the housing section in FIG. 5.
Figure 8:
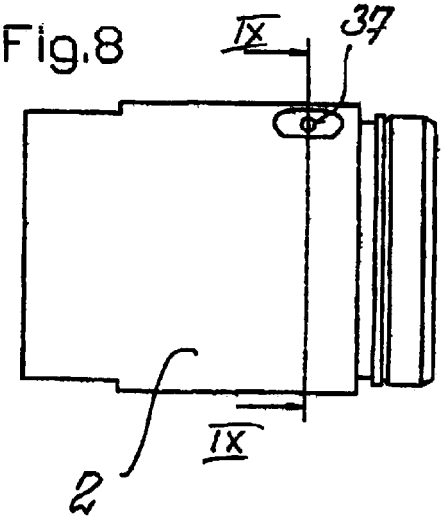
FIG. 8 is an end elevation of the housing section of FIG. 5.
Figure 9:
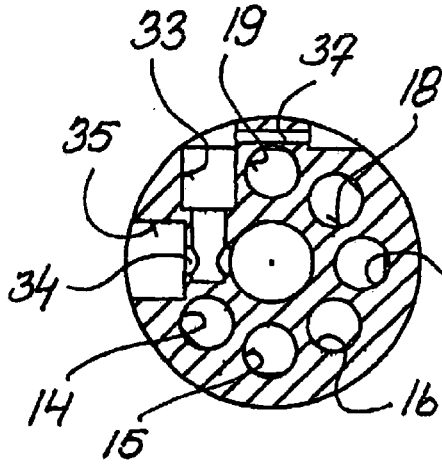
FIG. 9 shows a section in the direction f the arrows IX—IX in FIG. 8.
Figure 10:
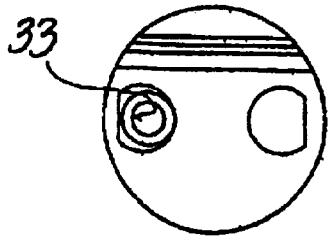
FIG. 10 is a partial view from above of the section illustrated in FIG. 9.

The embodiment of a device according to the present invention shown on the drawings and described in the following specification is intended to be mounted on the outlet from a fuel pump at a fuel station, whereafter a coaxial hose with a pistol valve at the opposite end is mounted in the upper end illustrated in FIG. 1 of the device according to the present invention. The embodiment shown in the drawings has a first housing or sleeve section 1 and a second housing or sleeve section 2. The first housing section 1 is shown in greater detail in FIGS. 2–4 and the second housing section 2 is shown in greater detail in FIGS. 5–10. The first housing section 1 is intended to be screwed in place on the outlet of a pump, a sealing ring 3 serving to seal between the outlet and the housing section 1. To this end, the housing section 1 has an inner thread which is adapted to the thread on the outlet of the pump. The second housing section 2 is interconnected with a coaxial hose by per se conventional means, e.g. suitable threads and sealing rings. The two housing sections 1 and 2 are interconnected with each other by means f suitable aids, e.g. an outer thread on the second housing section 2 and an inner thread on the first housing section 1. A sealing ring 4 is further disposed between the housing sections 1 and 2.

Figure 14:
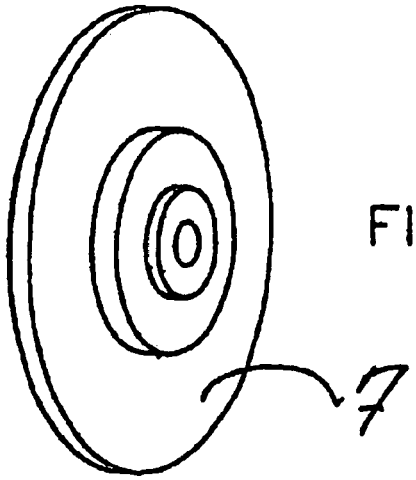
FIG. 14 is a perspective view of a cylinder bottom for the device in FIG. 1.
Figure 15:
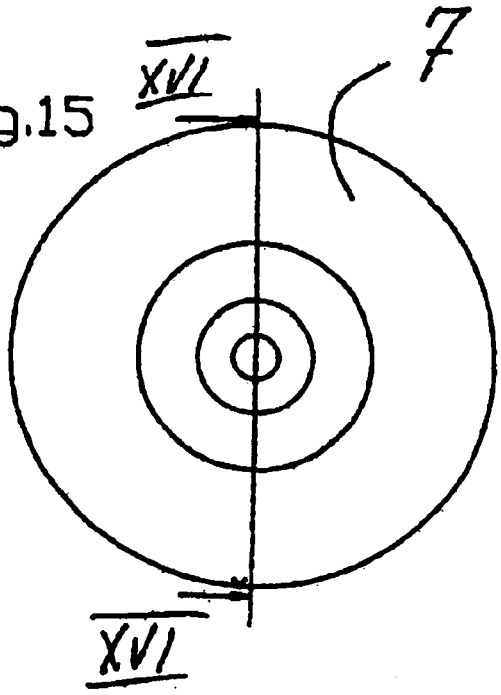
FIG. 15 shows an end elevation of the cylinder bottom in FIG. 14.
Figure 16:
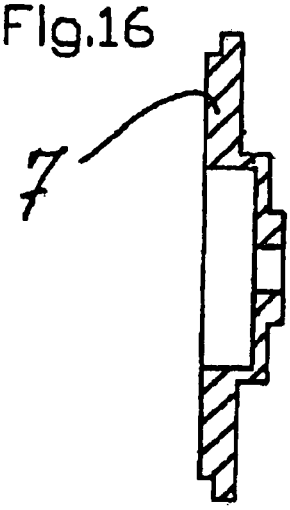
FIG. 16 shows a section in the direction of the arrows XVI—XVI in FIG. 15.

The first housing section 1 forms a through flow channel for the fuel and support for a cylinder top 5 which is provided with a cylinder wall 6. This cylinder top with the cylinder wall 6 is shown in greater detail in FIGS. 11–13. The cylinder is closed by means of a cylinder bottom 7 and this cylinder bottom is shown in greater detail in FIGS. 14–16. In the thus formed cylinder cavity, there is disposed a piston 8 which is shown in greater detail in FIGS. 17–20. A compression spring 9 is disposed between the piston 8 and the cylinder top 5 for urging the piston 8 against the cylinder bottom 7.

The piston rod 10 of the piston 8 extends through the cylinder bottom 7. The piston rod 10 extends into a valve seat 11 which is shown in greater detail in FIGS. 21–24. On the end of the piston rod 10, there is disposed a seat portion 12 for co-operation with the valve seat proper. The second housing section 2 has, as has been shown in greater detail in FIGS. 5–10, a central through flow channel 13 for the vapour which is to be recovered and is connected to the inner portion in a coaxial hose, this portion being intended for recovery and recycling of the vapour from the pistol valve. As is apparent from FIG. 1, the valve seat 11 is placed in the central through flow channel 13 which will thus serve for positioning of the different components included in the valve. The second housing section 2 also has a number of through flow channels 14, 15, 16, 17, 18, 19 which together form a through flow channel for the fuel. The valve seat 11 is sealed in the through flow channel 13 with the aid of a number of sealings 20, 21 and 22. These sealings may suitably consist of O-rings. The piston rod 10 may be guided in the valve seat 11 with the aid of a ring 23 sealing against the piston rod.

In the cylinder top 5 or in the upper region of the cylinder wall 6, there are provided a number f apertures 24, 25, 26, 27 which create a communication between the cylinder cavity and the surrounding through flow channel for the fuel. The end of the piston rod 10 extending through the cylinder top 5 is provided with a channel 28 which extends into a number of radially extending channels 29, 30 and 31. These channels 29, 30 and 31 discharge in that part of the cylinder cavity which is located between the piston 8 and the cylinder bottom 7.

Figure 1:
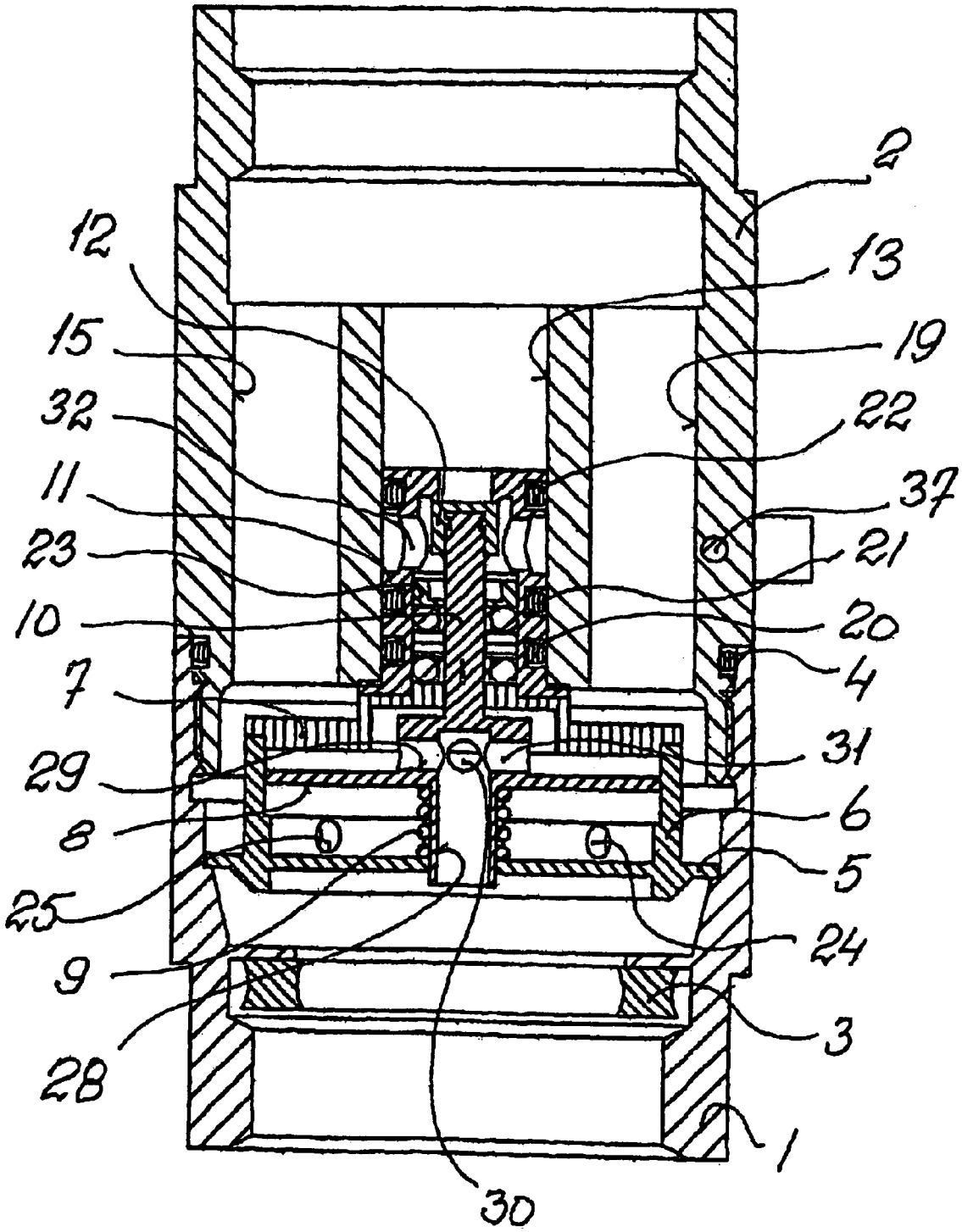
FIG. 1 shows a section through one embodiment of a device according to the present invention.

With the components in the position illustrated in FIG. 1, the valve is closed for vapour recovery, since the piston rod 10 with the piston 8 is placed in abutment against the valve seat because of the force from the compression spring 9. For attaining the desired spring force, the spring 9 may possibly consist of several springs which co-operate with each other. The valve seat or insert 11 has a space 32 around the valve seat end 12 on the piston rod 10. This space 32 is in communication with a radial aperture 33 in the second housing section 2. This aperture is intended for an adjustment screw 34 which is shown in greater detail in FIGS. 25–27. The aperture 33 crosses a channel 34 which leads to a gas recovery connection 35 on the side of the second housing section 2.

Figure 28:
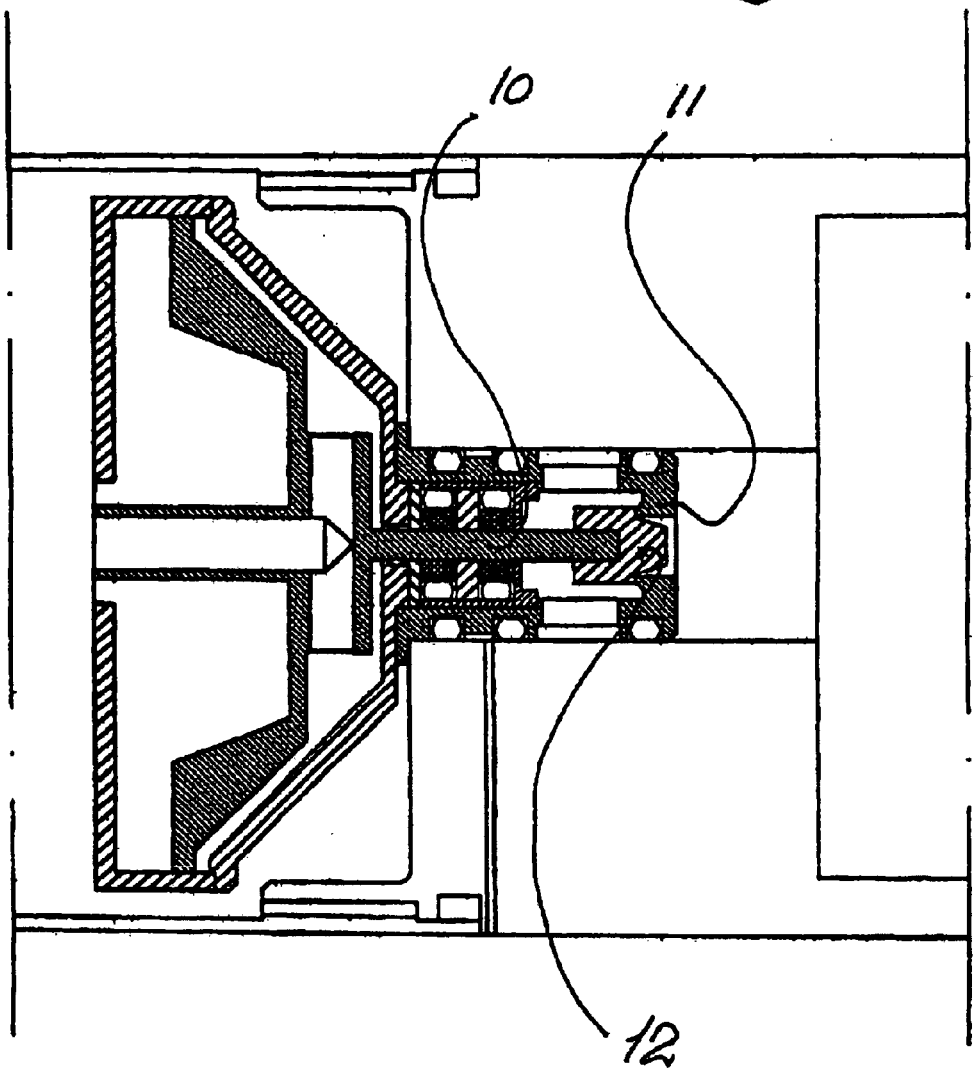
FIG. 28 is a schematic cross section through parts of an additional embodiment of the device according to the present invention.
Figure 29:
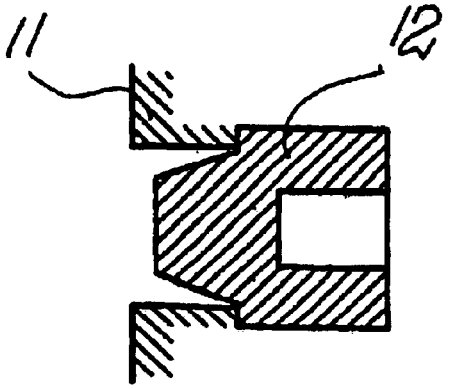
FIG. 29 is a schematic section through a further embodiment of the valve seat end of a piston rod for a device according to the present invention.
Figure 30:
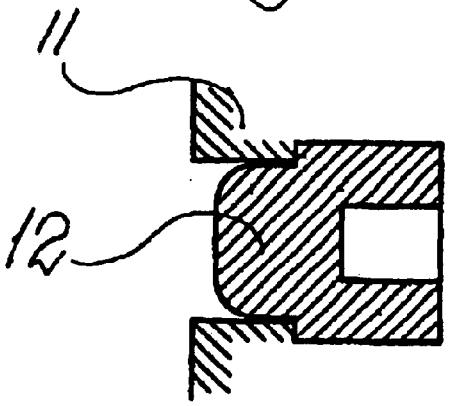
FIG. 30 shows a similar section to FIG. 29 of yet a further embodiment of a valve seat end for a device according to the present invention.

FIG. 28 shows a part of a further embodiment of the device according to the present invention with major focus on the piston rod 10 and its valve seat end 12 shown in greater detail in FIG. 30. FIG. 30 shows the valve seat end 12 in greater detail. FIG. 29 shows a further embodiment of a valve seat end 12. FIG. 31 shows a curve of the vapour rate at different gap dimensions between the valve seat 11 and the valve seat end 12. It is in all likelihood such that a valve seat end 12 according to FIG. 30 gives a suitable variation of gap for attaining a vapour rate of substantially 100% at different fuel through flow rates. FIG. 31 shows a curve of the gap dimension in a flow of 15–16 l/min for a vapour rate of 100%, the gap being 0.117.

Figure 11:
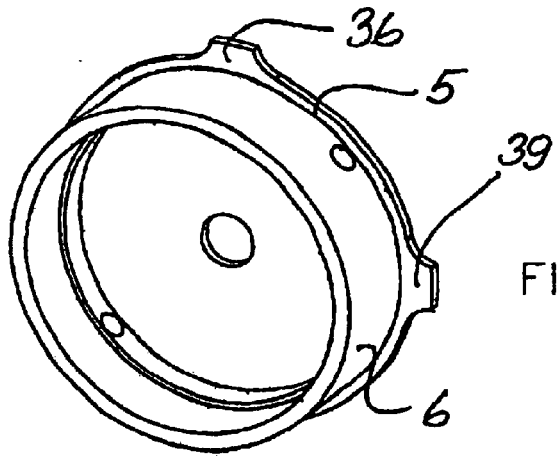
FIG. 11 is a perspective view f a cylinder top with cylinder wall for the device in FIG. 1.
Figure 12:
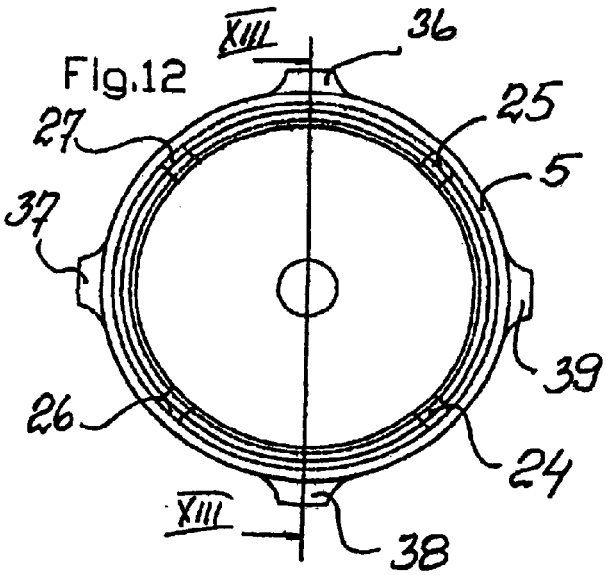
FIG. 12 shows a view of the cylinder top illustrated in FIG. 11.
Figure 13:
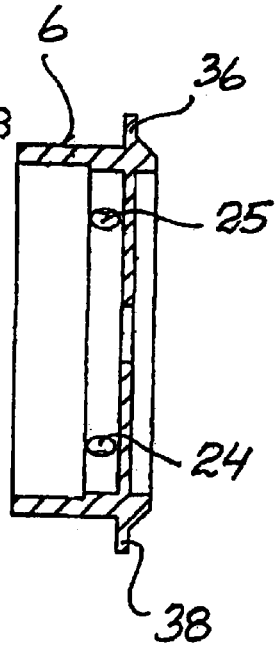
FIG. 13 is a section in the direction of the arrows XIII—XIII in FIG. 12.

As is apparent in FIGS. 11–13, the cylinder top 5 has four wings 36, 37, 38, 39 for positioning thereof in the first housing section 1 in such a manner that this does not prevent flow of fuel past to the through flow channels 15–19. Fuel also flows through the channel 28 and the radial apertures 29–31 and into the cylinder cavity between the piston 8 and the cylinder bottom 7. By a substantial pressure equalisation between the two cylinder cavities thanks to the apertures 24, 25, 26, 27, the piston 8 will be positioned in response to or corresponding to the fuel flow in the through flow channels 15–19. Purely theoretically, it would appear to be such that the absolute pressure is of no consequence, while the pressure drop occurring because of the flow or the flow rate will displace the piston 8 against the action f the spring 9.

The pressure drop is proportional to the flow of the fuel. This implies that the piston rod 10 and the seat portion 12 are displaced from the valve seat proper in proportion to the flow for allowing passage of vapour in proportion to the flow. The vapour flow may also be initially adjusted with the aid of the adjustment screw 36. A pin 37 is provided to prevent unscrewing of the adjustment screw 36.

Many modifications are naturally possible without departing from the scope of the inventive concept as this is defined in the appended claims.

What is claimed is:

1. A device for controlling the recovery of vapour at stations for the dispensing of liquid fuels, e.g. petrol of various grades, from a first tank or container to a second tank or container by the intermediary of a pump and a line and/or hose with a nozzle, e.g. a pistol valve, and with a channel and/or hose for the recovery and recycling of vapour from the second tank or container to the first, tank or container, or some other auxiliary aid for managing the vapour, wherein a valve is disposed in the line or hose between the pump and the nozzle and includes at least one through flow channel (14–19) for the fuel and at least one through flow channel (13) for the vapour which is to be recovered, the valve has a valve cone (12) and a valve seat (11), and the valve cone (12) is switchable against the action of a spring (9) from closure abutment against the valve seat corresponding to the fuel flow occurring in the through flow channel (14–19), so that vapour is recovered and recycled via the valve seat (11) in proportion to the fuel flow, characterised in that the valve cone (12) is disposed on the end of a piston rod (10) whose opposite end extends through a cylinder cavity and out of a cylinder top (5) and that said piston rod (10) has a plate (8) for movement in the cylinder cavity and co-operation with the cylinder wall (6).

2. The device as claimed in claim 1, characterised in that the opposite piston end has a channel (28) which is open in the piston end and which discharges on the opposite side of the plate (8) for communication with the part of the cylinder space located on this side of the plate.

3. The device as claimed in claim 1, characterised in that the cylinder cavity between the plate (8) and the cylinder top (5) is, by the intermediary of a number of apertures (24, 25, 26, 27), in communication with the surrounding through flow channel for the fuel.

4. The device as claimed in claim 1, characterised in that the opposite piston end carries a compression spring (9) between the plate (8) and the cylinder top (5) for urging the piston (10) from the cylinder top (5) and the valve cone in a direction towards the valve seat.

5. The device as claimed in claim 1, characterised in that the valve seat discharges in a space (32) for leading off vapour to the first tank or an auxiliary aid for management of the vapour.

6. The device as claimed in claim 5, characterised in that an outlet (34) is provided with an adjustment screw (36) for basic adjustment of the vapour recovery and recycling by means of the valve.

7. The device as claimed in claim 1, characterised in that the valve seat end (12) of the valve cone (10) is formed for realising a gap between the valve seat (11) and the valve seat end (12) which varies in response to the switching of the valve cone (10) in proportion to the fuel flow, for maintaining a vapour recovery of substantially approximately 100%.

* * * * *